US008325564B1

(12) United States Patent
Ruffa

(10) Patent No.: US 8,325,564 B1
(45) Date of Patent: Dec. 4, 2012

(54) OSMOTIC PRESSURE BASED CAVITATION SUPPRESSION SYSTEM

(75) Inventor: Anthony A. Ruffa, Hope Valley, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 374 days.

(21) Appl. No.: 12/844,304

(22) Filed: Jul. 27, 2010

(51) Int. Cl.
*G10K 11/00* (2006.01)

(52) U.S. Cl. ..... 367/171

(58) Field of Classification Search ..... 367/171
See application file for complete search history.

(56) References Cited

U.S. PATENT DOCUMENTS 2,981,357 A * 4/1961 Huckabay et al. ..... 367/68
3,776,361 A * 12/1973 Rolle ..... 367/150
3,961,305 A * 6/1976 Green ..... 367/171
4,364,117 A * 12/1982 Snow ..... 367/152
5,068,836 A * 11/1991 Steel ..... 367/174
5,233,972 A * 8/1993 Rattner ..... 601/4
5,936,913 A * 8/1999 Gill et al. ..... 367/25
6,050,361 A * 4/2000 Ruffa et al. ..... 181/108
7,266,046 B1 * 9/2007 Ruffa ..... 367/171
7,352,653 B2 * 4/2008 Cannelli ..... 367/147

* cited by examiner

*Primary Examiner* — Isam Alsomiri
*Assistant Examiner* — James Hulka
(74) *Attorney, Agent, or Firm* — James M. Kasischke; Michael P. Stanley; Jean-Paul A. Nasser

(57) ABSTRACT

An acoustic source for use in a saltwater environment includes a transducer for projecting acoustic energy. The transducer is positioned within a semi-permeable membrane. The volume around the transducer within the membrane is filled with water having a lower concentration of a solute such as salt. When positioned in the saltwater environment, an osmotic pressure is created within the membrane. This osmotic pressure acts to suppress cavitation such as that which could be generated by the transducer. In further embodiments a support structure is used to support the membrane and the transducer could be an array of transducers.

18 Claims, 2 Drawing Sheets

OSMOTIC PRESSURE BASED CAVITATION SUPPRESSION SYSTEM

STATEMENT OF GOVERNMENT INTEREST

The invention described herein may be manufactured and used by or for the Government of the United States of America for governmental purposes without the payment of any royalties thereon or therefor.

CROSS TO OTHER PATENT APPLICATIONS

None.

BACKGROUND OF THE INVENTION (1) Field of the Invention

The present invention relates to the field of cavitation suppression for sonar arrays, and more particularly to suppression of the cavitation that often occurs between closely spaced transducers operated at high source levels.

(2) Description of the Prior Art

It is well known that the interaction between adjacent transducers in a sonar array can produce cavitation due to acoustic effects alone. Cavitation is the phase change of water from liquid to vapor induced by a pressure drop in the water. The ideal inter-transducer spacing for an array of transducers disposed within a towed Variable Depth Sonar (VDS) needs to be a distance greater than or equal to one-half of the operational wavelength of the sonar in order to minimize acoustic interactions between adjacent transducers. However, low-frequency (and hence long wavelength) sonar systems often have the array transducers spaced much closer than one-half wavelength, usually only a few inches apart, in order to minimize the overall size of the sonar tow body. While a smaller tow body allows for ease in handling, such close transducer spacing produces areas (hot spots) between the transducers that are susceptible to cavitation production when the transducers are driven at high source levels. This cavitation damages the transducer surfaces over time, and the cavitation bubbles block the transmitted sound, thereby degrading the transmitted signal. One cavitation reduction solution that has been employed previously is to accept an undesirable reduction of the acoustic pressure (and hence, the source level of the operating array) with a corresponding decrease in sonar system performance. Another approach that has been tried is to fill in the gaps between closely spaced transducers with a rho-c rubber device thereby eliminating the presence of seawater between the hot spots. Such a solution however is complicated to design and relatively high in cost to construct.

What is needed is a low cost, simple-to-construct design for preventing cavitation from occurring between closely spaced transducers in a sonar array, even when the array is operated at high source levels.

SUMMARY OF THE INVENTION

Accordingly, it is a general purpose and primary object of the present invention to provide a cavitation suppression apparatus for use with sonar transducers.

It is a still further object that the present invention be capable of eliminating cavitation produced hot spots between adjacent closely spaced transducers when the sonar system is operated at high source levels.

It is a further object of the present invention that the cavitation suppression apparatus employ means requiring minimal additional resources.

The objects described above are accomplished with the present invention by providing an acoustic source for use in a saltwater environment that includes a transducer for projecting acoustic energy. The transducer is positioned within a semi-permeable membrane. The volume around the transducer within the membrane is filled with water having a lower concentration of a solute such as salt. When positioned in the saltwater environment, an osmotic pressure is created within the membrane. This osmotic pressure acts to suppress cavitation such as that which could be generated by the transducer. In further embodiments a support structure is used to support the membrane and the transducer could be an array of transducers. In this embodiment, cavitation between the transducers of the array can be suppressed.

The embodiment involves surrounding an acoustic transmitter (or an array of transmitters) with a closed semi-permeable membrane structure. The effective diameter of the membrane enclosure must be sufficiently large so that the acoustic pressure just outside of the enclosure will be low enough so that cavitation will not occur. If the enclosure is too small, cavitation will be suppressed just inside the enclosure due to the osmotic pressure but will still occur just outside the enclosure when the instantaneous negative acoustic pressure exceeds the hydrostatic pressure. In some cases the semi-permeable membrane structure will be quite large. In other embodiments, it may be more practical to focus on suppressing the cavitation occurring between closely spaced transducers.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DETAILED DESCRIPTION OF THE INVENTION

It is well known in the fluids art that two solutions having different solute concentrations, separated by a semi-permeable membrane that allows water molecules, but not solute molecules, to pass through will generate a pressure known as osmotic pressure. The osmotic pressure results from the difference in the collective force of solute molecules impinging on both sides of the membrane. For the present inventive utilization, seawater has been shown to generate a relatively high osmotic pressure of 24 atmospheres when separated from fresh water across a semi-permeable membrane. This increases the allowable source level by 27 dB at sea level before cavitation occurs, according to the formula $SL=20\log(P_o/P_{atm})$, where $P_o$ is the osmotic overpressure (24 atmospheres), and $P_{atm}$ is the sea level pressure, or 1 atmosphere.

Membranes used in reverse osmosis are generally made out of a polyimide material that is the type chosen in the preferred embodiment primarily for the permeability to water of polyimide combined with the relative impermeability of polyimide to various dissolved impurities including salt ions and other small molecules that cannot be filtered. Other examples of semi-permeable membranes that could also be used in the present invention without deviating from the teachings herein are dialysis tubing material membranes, cellulose ester membranes (CEM), charge mosaic membranes (CMM), bipolar membranes (BPM), anion exchange membranes (AEM), alkali anion exchange membranes (AAEM), and proton exchange membranes (PEM).

Cavitation is defined as the vaporization of water when the absolute pressure of the water approaches zero. For example, a source generating an acoustic pressure that exceeds ±1 atmosphere will cause cavitation at sea level.

Figure 1:
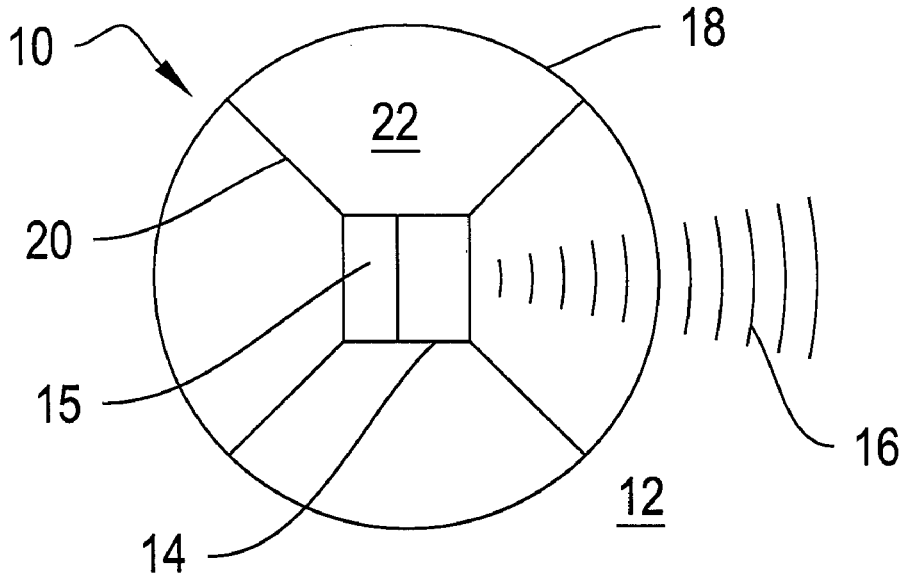
FIG. 1 provides a diagram of a first embodiment of an acoustic source built according to the teachings of the present invention.

In FIG. 1 there is shown a diagram of a first embodiment of the current invention. In this embodiment, an acoustic source 10 is surrounded by saltwater 12. Acoustic source 10 has a transducer 14 capable of generating acoustic energy 16. Transducer 14 is positioned inside and surrounded by a semi-permeable membrane 18. A signal source 15 is positioned inside membrane 18 and joined to transducer 14. Support members 20 position transducer 14 within membrane 18. Transducer 14 should be spaced away from membrane 18 far enough that acoustic energy 16 has dissipated sufficiently to avoid cavitation outside membrane 18. Interior region 22 of membrane 18 is filled with water having a lower salinity than surrounding seawater 12. Water can be freshwater, distilled water or any type of water having the required salinity for creating the necessary osmotic pressure.

When acoustic source 10 is positioned in saltwater 12 such as ocean water, water inside semi-permeable membrane 18 interior 22 will develop an osmotic pressure of around 24 atmospheres. Upon receiving a signal from source 15, transducer 14 will generate acoustic energy 16. Osmotic pressure inside membrane 18 significantly suppressing the onset of cavitation by increasing the cavitation threshold of the transducer by 27 dB. The high positive osmotic pressure thus generated can overcome large negative cavitation producing acoustic pressures. The 24 atmospheres of osmosis-produced overpressure only induces a low flow rate through membrane 18 inside source 10. The low flow rate of water out through the membrane 18 will not significantly affect source 10 over the timeframe of a typical mission.

It is also noted that freshwater has a slightly lower sound speed than seawater (1497 m/s vs. 1500 m/s at 25° C.) which may require slight adjustments in time delays for sonar system array steering using well known beam steering techniques. An additive could be provided to correct this. Source 10 could operate with less than the full 24 atmospheres of overpressure, allowing some low level of salinity to be intentionally introduced in water inside membrane 18 to compensate for sound speed differences between the water mediums while still suppressing unwanted cavitation.

Figure 2:
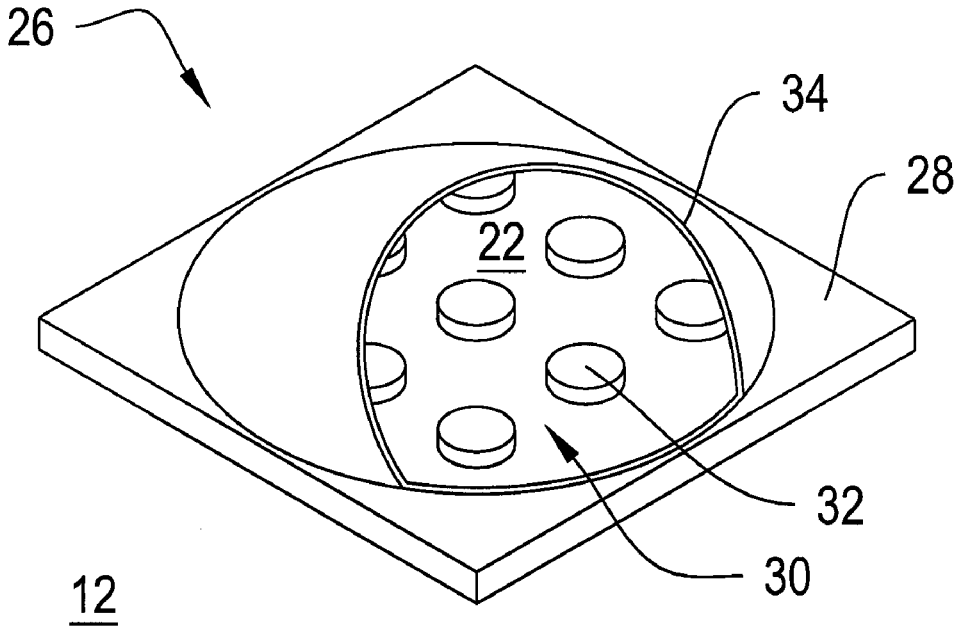
FIG. 2 depicts a partially cut-away isometric view of a second embodiment of an acoustic source.

In FIG. 2, there is shown a second embodiment of the inventive acoustic source, identified as 26. As before, acoustic source 26 is positioned in saltwater 12. Acoustic source 26 has a base plate 28. An array 30 of transducers 32 is secured to plate 28. Transducers 32 in array 30 can be jointly or independently controlled as is well known in the field of sonar. Array 30 is covered by a semi-permeable membrane 34 which is sealed against plate 28. Semi-permeable membrane 34 is shown in cut-away to reveal interior region 22 and array 30. Water having a lower solute content is provided within interior region 22 which is further defined as the volume between plate 28 and membrane 34. Again, there should be sufficient spacing between the array 30 and membrane 34 to avoid cavitation outside membrane 34. When source 26 is placed in saltwater 12, an osmotic pressure is created in the region between plate 28 and membrane 34. This pressure acts to suppress cavitation that could be induced by array 30.

Figure 3:
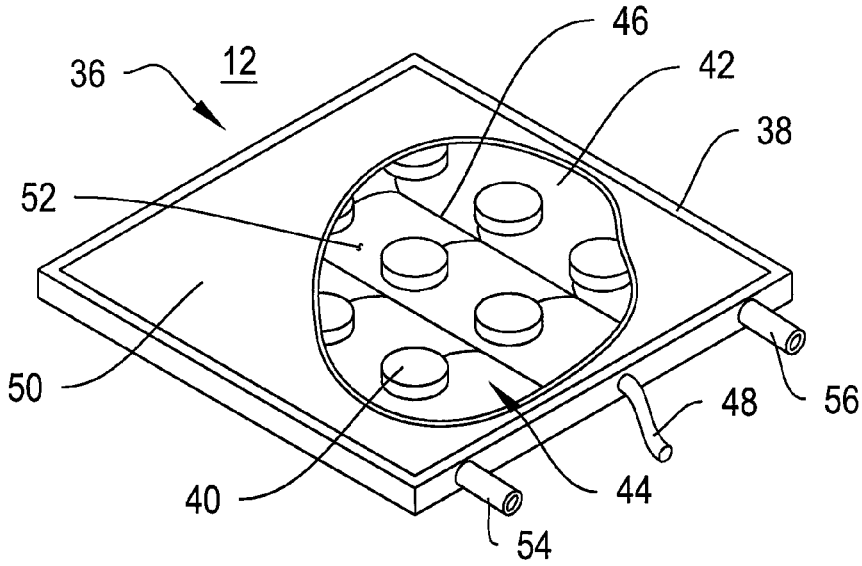
FIG. 3 depicts a partially cut-away isometric view of a third embodiment of an acoustic source.

In FIG. 3, there is shown a third embodiment of the inventive acoustic source, identified as 36. Acoustic source 36 can be positioned in saltwater 12 for operation. Source 36 has a frame 38 supporting transducers 40 therein. A support member 42 can be joined between transducers 40 and frame 38. Transducers 40 are arranged in an array 44. Transducers 40 are electrically joined through wires 46 to an electrical input 48 in communication outside frame 38. A semi-permeable membrane 50 is sealed against the exterior of frame 38. Membrane 50 can be sealed against one or both sides of frame 38. Membrane 50 should be positioned sufficiently far from array 44 to avoid cavitation outside membrane 50. If membrane 50 is not sealed against one side of frame 38 another suitable sealing member can be used. An interior volume 52 is defined by frame 38 and membrane 50. Membrane 50 is shown in cut-away to reveal array 44 and volume 52. The interior volume 52 is filled with water. As before, water is water having a lower concentration of solute than surrounding saltwater 12. In this embodiment of acoustic source 36, frame 38 includes a fluid input 54 and a fluid output 56. Fluid input 54 and output 56 allow refilling and replacement of water in volume 52. This can occur before or during operation.

When operating acoustic source 36 is filled with water in interior volume 52 and surrounded by saltwater 12. Water is osmotically pressurized by the difference in concentration across membrane 50. Electrical input 48 provides a signal through wires 46 to transducers 40 in array 44. Array 44 generates an acoustic signal. Acoustic signal is prevented from inducing cavitation by the surrounding osmotic pressure. Should too much water escape through semi-permeable membrane 50, fluid input 54 can be used to replenish the water.

Figure 4:
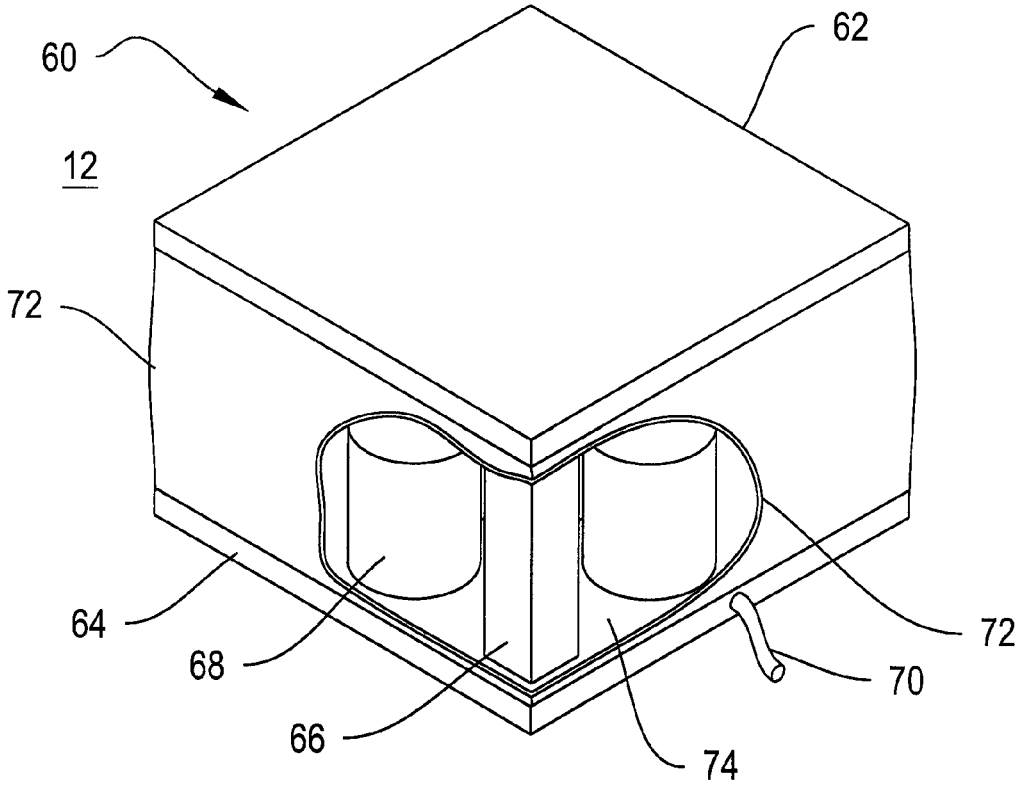
FIG. 4 depicts a partially cut-away isometric view of a fourth embodiment of an acoustic source.

In FIG. 4, there is shown a fourth embodiment of the acoustic source, identified as 60. Acoustic source 60 has at least one acoustically transparent plate 62. Source 60 has a second plate 64 that can be acoustically transparent. Acoustically transparent plate 62 and second plate 64 are spaced apart from one another by supports 66. One or more transducers 68 are positioned between plates 62 and 64. Transducers 68 can be joined to an electrical input 70 in order to provide transducers 68 with electrical signals. A semi-permeable membrane 72 is sealed against the outer edges of plates 62 and 64 creating a sealed volume 74 between plates 62 and 64. Membrane 72 is partially cut away to show the interior of plates 62 and 64. Sealed volume 74 is filled with water having a low solute content. Acoustic source 60 is positioned for operation in saltwater 12.

In operation, transducers 68 generate acoustic energy through acoustically transparent plate 62. Acoustically transparent plate 62 should be positioned sufficiently far from transducer 68 so that acoustic energy doesn't cause cavitation on the saltwater 12 side of plate.

The present invention has many advantages and new features. The invention provides a low cost, practical approach for increasing the effective static pressure around an array of transducers susceptible to cavitation, thereby suppressing the onset of such cavitation. The overpressure developed inside the source is not affected by increases in depth, in contrast to other cavitation reduction methods. Being able to pack transducers closer than one-half wavelength together permits use of smaller tow body that is easier to deploy and retrieve. The low flow rate of water across the membranes will not impact missions of typical length.

What has thus been described is an apparatus for suppressing cavitation produced hot spots that are generated between closely-spaced transducers disposed in a low frequency transducer array that is designed for immersive use in seawater. The transducers are enclosed within a water filled structure having semi-permeable membranes separating the interior water from the surrounding seawater. The interior water has a lower concentration of salt than the surrounding seawater. The presence of water inside the structure produces substantial osmotic pressure across the membrane and within the structure. The osmotic pressure raises the cavitation threshold pressure level that in turn suppresses the onset of cavitation when the sonar array is operated at high source levels.

Obviously many modifications and variations of the present invention may become apparent in light of the above teachings. The invention can be used to suppress cavitation for many other types of transducers because the concept is very general. Many types of semi-permeable membranes may be used within the scope of the invention as taught. Semi-permeable membranes surrounded by a higher-solute solution can also provide an approach to apply static overpressure to a cavitation-prone component when the design can tolerate a small amount of flow across the membrane.

In light of the above, it is therefore understood that within the scope of the appended claims, the invention may be practiced otherwise than as specifically described.

What is claimed is:

1. An acoustic source for use in a saltwater environment comprising:

a transducer capable of projecting acoustic energy;

a semi-permeable membrane surrounding said transducer and being capable of defining an interior volume separated from the saltwater environment; and water contained within said semi-permeable membrane, said water having a lower concentration of solute therein than the saltwater environment.

2. The device of claim 1 further comprising a structure for positioning said transducer within said semi-permeable membrane.

3. The device of claim 1 wherein said transducer has at least one face for projecting acoustic energy.

4. The device of claim 3 wherein said transducer face is positioned a sufficient distance away from said semi-permeable membrane to avoid formation of cavitation bubbles exterior to said semi-permeable membrane.

5. The device of claim 1 further comprising a water source containing lower solute concentration water in communication into said semi-permeable membrane interior.

6. The device of claim 5 further comprising a water outlet in communication between said semi-permeable membrane interior and said semi-permeable membrane exterior.

7. The device of claim 1 further comprising a signal source in communication with said transducer.

8. The device of claim 7 wherein said signal source is located inside said semi-permeable membrane.

9. The device of claim 7 wherein said signal source is located outside said semi-permeable membrane.

10. An acoustic source for use in a saltwater environment comprising:

a transducer capable of projecting acoustic energy;

a structure supporting said transducer;

a semi-permeable membrane joined to said structure and in combination with said structure defining an interior volume separated from the saltwater environment; and water contained within said interior volume, said water having a lower concentration of solute therein than the saltwater environment.

11. The device of claim 10 further comprising a water source containing lower solute concentration water in communication into said interior volume.

12. The device of claim 11 further comprising a water outlet in communication between said interior volume and an exterior of the combined semi-permeable membrane and structure.

13. The device of claim 10 wherein said transducer has at least one face for projecting acoustic energy.

14. The device of claim 13 wherein said transducer face is positioned a sufficient distance away from an exterior of said combined semi-permeable membrane and structure to avoid formation of cavitation bubbles exterior to said combined semi-permeable membrane and structure when operating.

15. The device of claim 13 wherein:

said structure is acoustically transparent at an operating frequency range of said transducer; and said transducer face is oriented to generate acoustic energy through said structure.

16. The device of claim 13 wherein said transducer face is oriented to generate acoustic energy through said semi-permeable membrane.

17. The device of claim 10 further comprising a towed variable depth sonar body wherein said acoustic source is positioned within said variable dept sonar body.

18. The device of claim 10 wherein said transducer is an array of transducers.

* * * * *